United States Patent [19]

Bohme et al.

[11] 4,394,907

[45] Jul. 26, 1983

[54] DISPLACEMENT ERROR CORRECTION IN SORTING SYSTEMS

[75] Inventors: Rolf C. Bohme, Kyalami; Max M. Lazerson, Northcliff, both of South Africa

[73] Assignee: General Mining Union Corporation, Limited, Johannesburg, South Africa

[21] Appl. No.: 212,515

[22] Filed: Dec. 3, 1980

[30] Foreign Application Priority Data

Dec. 4, 1979 [ZA] South Africa ..... 79/6566
Jul. 15, 1980 [ZA] South Africa ..... 80/4248

[51] Int. Cl.[3] ..... B07C 5/346

[52] U.S. Cl. ..... 209/556; 209/576; 209/589; 250/252.1; 364/555; 364/579

[58] Field of Search ..... 209/552, 555, 556, 558, 209/576, 577, 586, 589; 250/252, 282, 359; 364/460, 555, 564, 571, 579

[56] References Cited

U.S. PATENT DOCUMENTS 3,075,641 1/1963 Hutter et al. ..... 209/589 X
3,242,342 3/1966 Gabar ..... 209/552 X
3,282,116 11/1966 Jones ..... 209/555 X
3,588,480 6/1971 Unger et al. ..... 364/564
3,712,469 1/1973 Dwyer et al. ..... 209/586 X
3,832,549 8/1974 Mangan et al. ..... 250/252 X
3,987,391 10/1976 Hogg ..... 364/571 X
4,194,634 3/1980 Kelly ..... 209/589
4,246,098 1/1981 Conway et al. ..... 209/589
4,317,521 3/1982 Clark et al. ..... 209/589 X
4,320,841 3/1982 Gordon et al. ..... 209/589 X

FOREIGN PATENT DOCUMENTS 1575850 6/1969 France ..... 209/586

*Primary Examiner*—Robert B. Reeves
*Assistant Examiner*—Edward M. Wacyra
*Attorney, Agent, or Firm*—Scully, Scott, Murphy & Presser

[57] ABSTRACT

In radiometric sorting a method of compensating for the count recorded by a detector for an ore particle which is displaced from the center line of the detector. The compensation is effected by applying one of a plurality of calibration factors to the detector count. The calibration factors are statistically determined and are dependent on the measured displacement and optionally on at least one of the shape, height, volume or mass of the particle.

8 Claims, 5 Drawing Figures

DISPLACEMENT ERROR CORRECTION IN SORTING SYSTEMS

FIELD OF THE INVENTION

This invention relates to sorting systems and particularly to the sorting of radiometric ore.

BACKGROUND TO THE INVENTION

In a radiometric particle sorter the ore particles are arranged in a plurality of spaced lines with the individual particles in each line being spaced from one another. Each line of particles is directed along a counting channel over a succession of detectors which are housed in a lead shield and the radioactive counts recorded by the detectors for each particle are accumulated to obtain a measure of the radioactive content of the particle.

Ideally the particles pass down the centre line of the channel and so are exposed under identical conditions to the detectors. In practice, though, due to the requirements of a high tonnage throughput and the limitations of the particle feeding system together with the fact that the sorter must be capable of handling particles having a size range of 2:1 or possibly 3:1 and the necessity of having a counting channel width within the lead shielding of about 2 to 3 times the nominal maximum particle size to avoid pile-up and jamming of particles within the counting channel, many particles, particularly smaller ones, are laterally displaced from the centre line of the counting channel and consequently from the centre line of the scintillation detectors.

The scintillation detectors normally have a scintillation crystal of 75 mm diameter as maximum cross sectional dimensions for several reasons, including minimising the effect of the following and preceding particles at acceptable particle separations and keeping background count low to maintain sensitivity and selectivity for small low grade particles. Many particles are therefore considerably displaced laterally from the centre line of the detectors, and give a considerably reduced count compared to the same particles travelling over the centre line of the detectors, due to the inverse square law attenuation of radiation and also due to the effect of particle-detector geometry.

Certain sorting machines previously described or built have compensated for this effect by using a single plane projected area volume measuring device to measure the lateral offset of the particle from the centre line, and adjust the reading of the projected area to compensate for the offset in a data processor to derive the particle's grade, i.e. the measured projected area or apparent volume, is reduced to compensate for the lower counts which the particle gives due to its offset. While this method gives acceptable results if only high grade particles giving counts considerably above background counts are being handled, it is not satisfactory when sorting low grade particles with counts only slightly above background counts, as this correction for lateral displacement by reduction of the apparent mass can result in a barren particle accumulating a background level count being processed to appear as an ore particle.

SUMMARY OF THE INVENTION

According to the invention a method of compensating for the lateral displacement of a particle from a reference line related to at least one detector which is responsive to a desired property in the particle and which produces an output signal which is dependent on the degree to which the particle possesses the property includes the steps of obtaining a measure of the lateral displacement of the particle from the reference line, and applying to the output signal a correction factor which is dependent on the measure of the lateral displacement.

To avoid the apparent ungrading of a barren or very low grade particle the correction factor is applied only if the output signal exceeds a predetermined minimum. The minimum may be statistically determined.

A plurality of correction factors may be predetermined experimentally with each correction factor being associated with a specific lateral displacement or a lateral displacement within a given range.

Further according to the invention the correction factor is additionally dependent on a physical characteristic of the particle.

The physical characteristic may be at least one of the shape, height, volume or mass of the particle.

The invention also provides a method of sorting particles which includes the steps of causing the particles to move in line spaced from one another sequentially past a plurality of in-line detectors, the detectors being responsive to the presence of a desired property in the particles and each producing, for each particle, an output signal which is dependent on the degree to which the property is present in the particle, and, for each particle, accumulating the output signals of the detectors, obtaining a measure of the displacement of the particle from the centre line of the detectors, and applying to the accumulation of the output signals a correction factor which compensates for the displacement of the particle from the centre line.

The invention also includes the step of categorizing the particle according to a physical characteristic, the correction factor being dependent on the said characteristic.

BRIEF DESCRIPTION OF THE DRAWINGS

The invention is described by way of example with reference to the accompanying drawings in which.

DETAILED DESCRIPTION OF THE INVENTION

Figure 1:
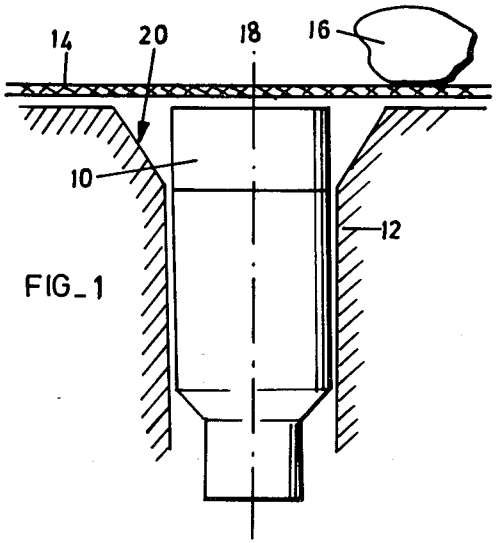
FIG. 1 schematically illustrates a particle travelling off centre over a scintillation counter.

FIG. 1 shows a scintillation detector in an ore sorting machine which includes a crystal 10 surrounded by lead shielding 12. A belt 14 carries particles 16 which are to be sorted over the crystal.

The shielding 12 is employed to reduce the effects of extraneous radiation, whether background or fringing radiation from adjacent particles, on the count recorded by the crystal of the radioactivity of the particle under test. The shielding however simultaneously makes the crystal more sensitive to direction and consequently if the particle is displaced from the centre line 18 of the crystal the count recorded by the crystal is reduced. This reduction may be combated to some degree though by chamfering the upper rim 20 of the lead shielding thereby increasing the sensitivity of the detector to off-centre particles, but this makes the detector more susceptible to stray radiation.

Figure 2:
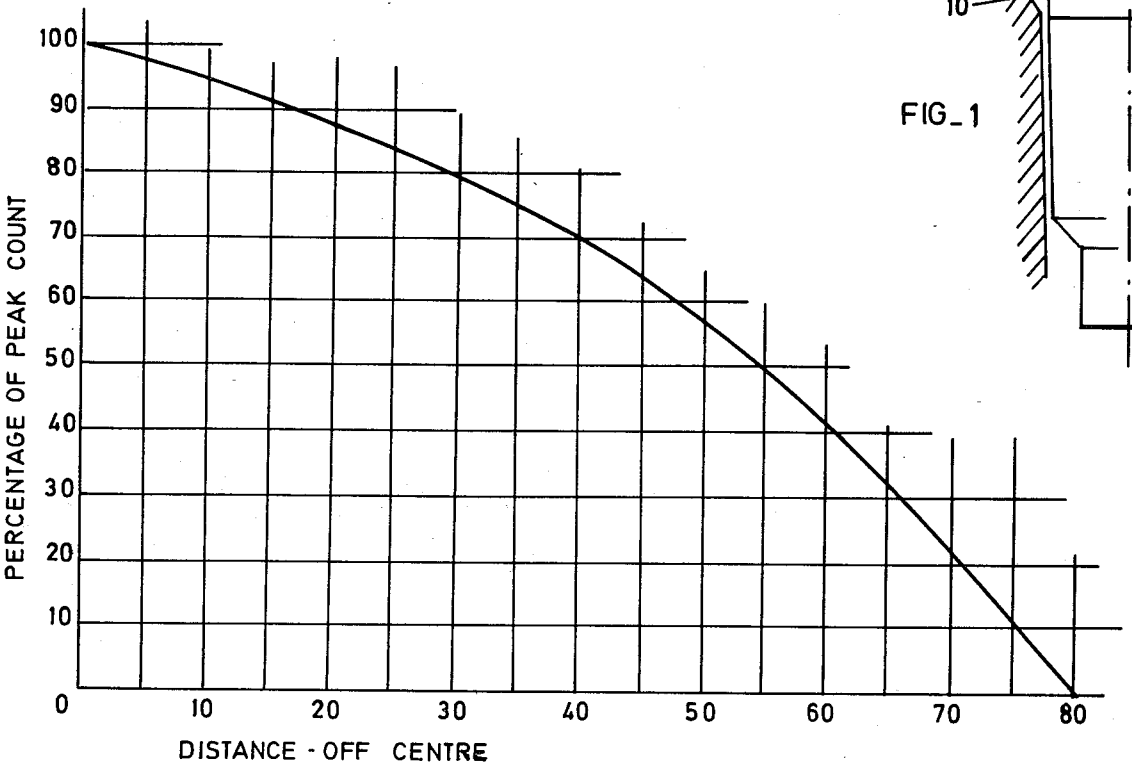
FIG. 2 illustrates the reduction in count recorded by the counter as the particle goes off centre, expressed as a percentage of the maximum count recorded for the particle on the centre line of the detector.

The relationship of count reduction to centre line displacement is shown in FIG. 2. The curve of FIG. 2 is dependent on the shape and size of the particle under test and on the chamfer angle and size but nonetheless exhibits under practically all conditions in operation a sharp reduction for recorded count as the distance off-centre increases.

Figure 3:
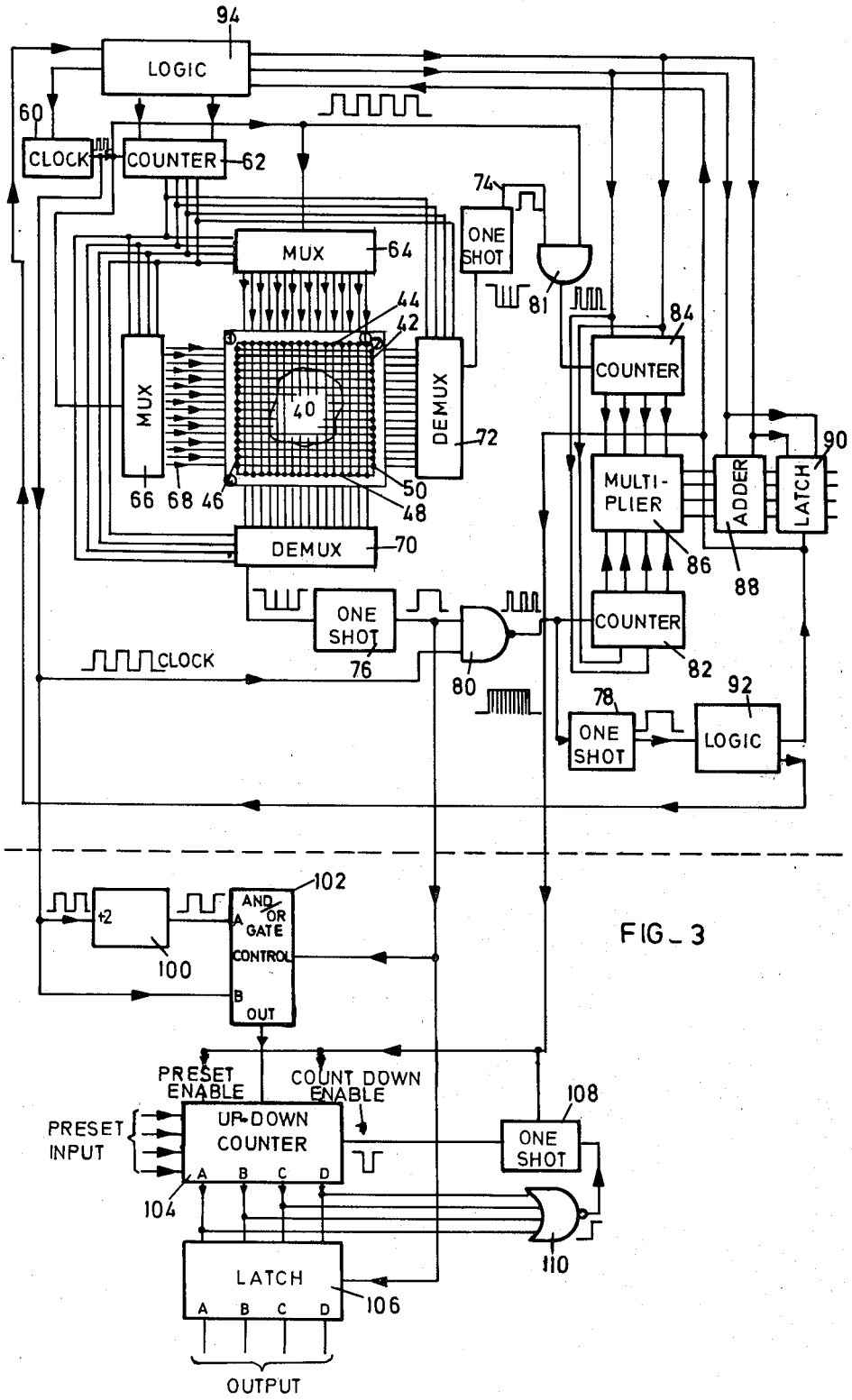
FIG. 3 illustrates a circuit diagram of electronic circuitry employed to determine the lateral displacement of a particle.

The present invention is based on the adjustment which is dependent on the off-centre displacement of a particle being made to the recorded count for the particle. The circuit illustrated in FIG. 3 is employed to determine the lateral displacement of a particle.

The circuit is divided by means of a dotted line into upper and lower sections. The upper section forms the subject of South African Patent Application No. 80/4250 entitled "Volumetric Measurement", but its working is briefly described hereinafter. The lower section calculates the lateral displacement of a particle from a reference line using the data produced in the upper section.

The arrangement shown in the upper section is intended for the volumetric measurement of a particle 40 projected in free flight from the end of a conveyor belt through a frame 42. The frame carries arrays of light emitting diodes and photo transistors and the numerals 44 and 46 denote horizontal and vertical arrays respectively of light emitting diodes, and the numerals 48 and 50 denote corresponding horizontal and vertical arrays respectively of photo transistor sensors.

The circuitry of the upper section includes a clock oscillator 60, a four bit binary counter 62, two 16 channel analog multiplexers 64 and 66 associated with the horizontal and vertical arrays of diodes respectively, high power driver circuits 68, two corresponding 16-channel de-multiplexers 70 and 72 respectively, retriggerable one-shots (astable multivibrators) 74, 76 and 78, AND gates 80 and 81, four bit binary counters 82 and 84, a multiplier 86, a parallel adder 88, a latch 90 and logic units 92 and 94 respectively. The latter logic unit is used for gating, reset, and count enable, logic. The former unit is used to detect the length of the particle in its direction of travel. The clock oscillator 60 drives the 4-bit binary counter 62. The 4-bit output of the binary counter 62 is decoded by the 16 channel analog multiplexer 66 which sequences the diodes in the vertical array 46, and by the multiplexer 64 which sequences the diodes in the horizontal array 44. The outputs of the multiplexers are fed to the high power driver circuits 68 which drive the light emitting diodes to give very high intensity light pulses.

The action of each multiplexer is sequentially to pulse the light emitting diodes in each array as described. The associated light detecting photo transistor outputs are fed in parallel to the 16 channel demultiplexers 72 in the vertical plane and 70 in the horizontal plane. As these demultiplexers are synchronously driven by the binary counter 62 the pulse sequence output of the demultiplexers corresponds to the sequential pulsing of the respective diode arrays, and a high or low logic pulse is obtained from each photo transistor depending on whether it is obscured or not.

The outputs of the demultiplexers are passed to the retriggerable one shots 76 and 74, respectively, setting the width and height of the particle. The width pulse is used to gate the clock pulse through the AND gate 80 and the height pulse gates the clock pulse through the AND gate 81. The outputs of the gates are passed to the counter 84 for the vertical plane, and to the counter 82 for the horizontal plane.

The gating- , reset- and count enable logic section 94 resets the binary counters at the beginning of each scan, and stops the binary counters at the end of each scan cycle.

Thus at the end of each scan cycle a count corresponding to the number of photo transistors obscured in the vertical plane is stored in the binary counter 82 and a count corresponding to the number of photo transistors obscured in the horizontal plane is stored in the binary counter 84. The binary outputs of these counters are fed to the 4-bit×4-bit multiplier system 86, and the 16 bit output of this multiplier, corresponding to the projected cross-sectional area of a 5 mm long slice of the particle is passed to the incremental parallel adder system 88. The incremental adder system is reset to zero by the gating-reset and count enable logic system 84 when an incoming particle is first detected by the photo transistors, and a 16-bit multiplier product representing the cross-sectional area of a 5 mm slice is then added incrementally, or accumulated, at the end of each sequential scan of the particle, the total summation over the length of the particle thus being the projected volume of the particle. After the end of the particle has been detected by the particle length logic unit 92, the output latch 90 is enabled and the output of this latch representing the projected particle volume is then available for further processing as required.

The lower section of the circuit i.e. the section below the dotted line includes a divide-by-2 flip-flop 100, an AND/OR gate 102, an UP-DOWN preset counter 104, a latch 106, a NOR gate 108, and a multiple input one-shot 110.

The clock pulses, each pulse corresponding to say a 5 mm distance in the upper section i.e. sizer unit, (this being the distance between the pairs of LED's and Phototransistors) are passed to the flip-flop 100. The direct clock pulses also go to an input B of the gate 102, and the half clock frequency pulses from the flip-flop 100 go to an input A of the gate 102. At the beginning of a sizer scan the Q output of retriggerable one-shot 76, representing the particle length, is low, as no particle is obscuring the light beam, and this low output then sets the gate 102 so that the input B is selected and passed from the output to the counter 104. Again, at the beginning of a sizer scan the logic unit 94 output presets the counter 104 to 8 and the trailing negative edge of the preset pulse enables the count-down mode. The counter 104 then counts the clock pulses until a particle obscures a light beam. The output of the one shot 76 then goes high for the width of the particle. This high input on the gate 102 then selects input A with input at $\frac{1}{2}$ clock frequency, and the counter 104 then counts at $\frac{1}{2}$ clock frequency for the width of the particle. This high level from the one shot 76 also enable the latch 106 so that the counts on the output of the counter 104 are transferred to the output of the latch 106. The one shot 76 goes low when the sizer scan has passed the edge of the particle, and this low level then latches the output of the latch 106 to hold the counts to the edge of the particle. As the counter 104 was counting at half clock frequency during the width of the particle, and as the counter was preset to count down from 8, the output of the latch 106 then represents the lateral displacement of the centre of the particle from the centre of the sizer unit in units of 5 mm.

If the particle extends beyond the centre of the sizer unit, or lies wholly beyond the centre, then the counter 104 continues counting down until binary count 0, when the counter's outputs are all low, and therefore the output of the gate 108 goes high. This triggers the one shot 110 and the output thereof is inhibited when the counter is preset in the count-down mode at the beginning of a sizer scan. As 0 output on the counter is then equivalent to the centre line of the sizer unit, the distance of the output particle from the centre line of the scanner is measured irrespective of the lateral position of the particle.

Figure 4:
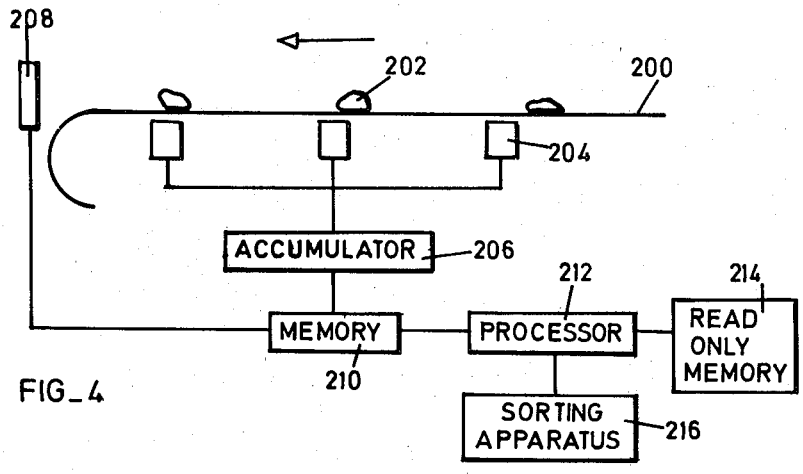
FIG. 4 is a simplified block diagram of a sorting system which incorporates the method of the invention.

FIG. 4 is a simplified schematic representation of a sorting system wherein corrections are made to compensate for the lateral displacements of the particles.

The particles 200 to be sorted are moved in line from one another on a conveyor belt 202 sequentially past a plurality of in line detectors 204. The radioactivity counts from the detectors associated with each particle are separately totalled in an accumulator 206, for example in the manner described in South African Patent Application No. 78/3198. The volume and lateral displacement of each particle are measured, in the manner described, by means of apparatus 208, similar to that shown in FIG. 3.

The data from the accumulator 206 and the apparatus 208 is stored in a memory 210 of a processor 212. A read only memory 214, which holds a matrix of empirically determined correction factors pertaining to lateral displacement, is accessible by the processor 212. The correction factors are based on curves of the type shown in FIG. 2 and are determined under laboratory conditions by measuring the characteristics of representative ore samples. The particles are categorized according to relevant parameters such as their volume or height, mass, or shape. In this respect use may be made of the techniques described in the applicant's South African Patent Application Nos. 80/4250 and 80/4249, entitled "Volumetric Measurement" and "Grade Determination" respectively.

For each category of particles measurements are made on representative detectors to obtain the count reduction/off-centre displacement relationship shown in FIG. 2. This data is stored in the memory 214.

Each particle on the belt 202 is categorized from the data held in the memory 210 and, when its centre line displacement is known, a look up routine is employed by the processor to locate the appropriate correction factor in the memory 214. If the correction factors are expressed in the same manner as the curve of FIG. 2, i.e. as the peak percentage count of a particle related to its distance off centre then the accumulated count output by the accumulator 206 must be multiplied by the inverse of the percentage reduction value. This is easily effected by the processor.

After further, known, calculations to obtain the grade of the particle using the corrected count value an accept/reject decision is made by the processor and known sorting apparatus 216 e.g. an air blast nozzle is actuated accordingly.

A further refinement introduced by the invention is that a correction factor is only applied to an output signal if the output signal is in excess of an empirically determined minimum dependent inter alia on background levels. This prevents upgrading of barren or very low grade particles.

Figure 5:
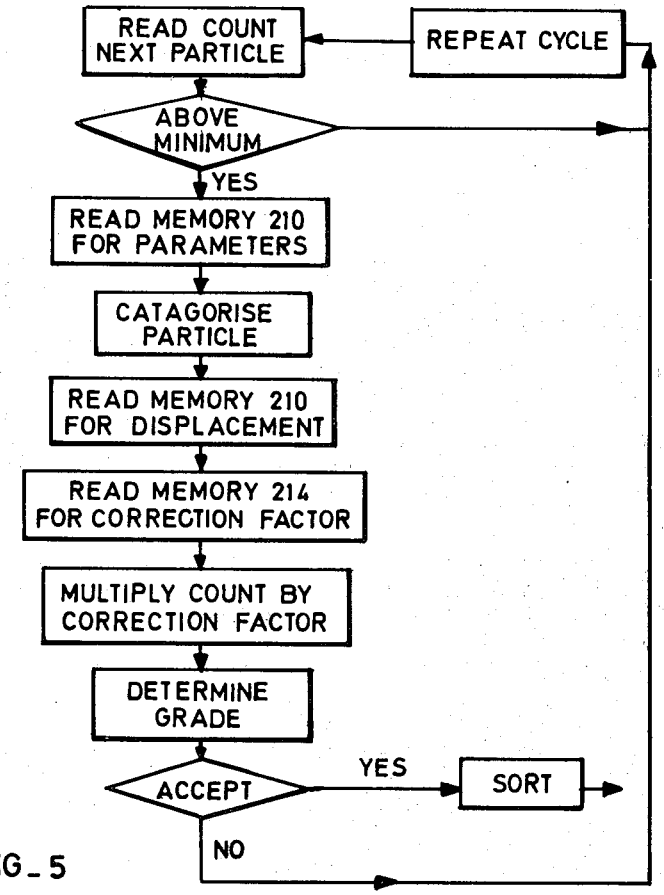
FIG. 5 is a flow chart of a programme executed by the system of FIG. 4.

FIG. 5 is largely self explanatory and illustrates a simplified flow chart of the programme executed by the processor 212 to effect the calculations referred to; the preparation of such a programme is well within the capabilities of those skilled in the art and consequently the flow chart is merely by way of illustration and does not purport to be exhaustive.

In similar vein the circuit elements and arithmetic and logic blocks shown in FIG. 3 are all standard circuit elements well known to those skilled in the digital electronic art, so full circuit details are not given. The system shown comprises a 16 element array, with a corresponding electronic system, but this array can obviously be expanded to arrays with more elements.

We claim:

1. A method of compensating for the lateral displacement of a particle from a reference line related to at least one detector which is responsive to a desired property in the particle and which produces an output signal which is dependent on the degree to which the particle possesses the property includes the steps of obtaining a measure of the lateral displacement of the particle from the reference line, and applying to the output signal a correction factor which is dependent on the measure of the lateral displacement.

2. A method according to claim 1 wherein the particle is caused to pass a plurality of the detectors, the output signals of the detectors being accumulated, and the correction factor being applied to the accumulation of the output signals.

3. A method according to claim 2 wherein the correction factor is applied only if the accumulation exceeds a predetermined value.

4. A method according to claim 1 wherein the correction factor is additionally dependent on a physical characteristic of the particle.

5. A method according to claim 4 wherein the physical characteristic is at least one of the shape, height, volume or mass of the particle.

6. A method of sorting particles which includes the steps of causing the particles to move in line spaced from one another sequentially past a plurality of in-line detectors, the detectors being responsive to the presence of a desired property in the particles and each producing, for each particle, an output signal which is dependent on the degree to which the property is present in the particle, and, for each particle, accumulating the output signals of the detectors, obtaining a measure of the displacement of the particle from the centre line of the detectors, and applying to the accumulation of the output signals a correction factor which compensates for the displacement of the particle from the centre line.

7. A method according to claim 6 including the step of categorizing the particle according to a physical characteristic, the correction factor being dependent on the said characteristic.

8. A method according to claim 7 wherein the physical characteristic is a least one of the shape, height, volume or mass of the particle.

* * * * *